US008213652B2

(12) United States Patent
Boguslavskij et al.

(10) Patent No.: US 8,213,652 B2
(45) Date of Patent: Jul. 3, 2012

(54) MULTI-COMPONENT HEARING AID SYSTEM AND A METHOD FOR ITS OPERATION

(75) Inventors: Mihail Boguslavskij, Coburg (DE); Volker Gebhardt, Neunkirchen am Brand (DE); Gottfried Rückerl, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1015 days.

(21) Appl. No.: 12/215,374

(22) Filed: Jun. 26, 2008

(65) Prior Publication Data

US 2009/0010465 A1 Jan. 8, 2009

Related U.S. Application Data

(60) Provisional application No. 60/958,089, filed on Jul. 2, 2007.

(51) Int. Cl.
*H04R 25/00* (2006.01)

(52) U.S. Cl. ..... 381/315; 381/317; 381/318; 381/328

(58) Field of Classification Search ..... 381/315, 381/328, 317, 318

See application file for complete search history.

(56) References Cited

U.S. PATENT DOCUMENTS

| | | | | |
|---|---|---|---|---|
| 5,083,312 | A | 1/1992 | Newton et al. | |
| 5,765,113 | A | 6/1998 | Russo et al. | |
| 6,381,476 | B1 | 4/2002 | Yoshida | |
| 2002/0115408 | A1 * | 8/2002 | Van Willigen | 455/13.1 |
| 2003/0065308 | A1 | 4/2003 | Lebel et al. | |
| 2003/0100280 | A1 | 5/2003 | Kusbel et al. | |
| 2003/0228882 | A1 | 12/2003 | Ezumi | |
| 2004/0053578 | A1 | 3/2004 | Grabon et al. | |
| 2005/0075692 | A1 | 4/2005 | Schommer et al. | |
| 2006/0067549 | A1 * | 3/2006 | Puder et al. | 381/315 |
| 2006/0093174 | A1 | 5/2006 | Niederdrank et al. | |
| 2007/0116308 | A1 | 5/2007 | Zurek et al. | |

FOREIGN PATENT DOCUMENTS

| | | | |
|---|---|---|---|
| DE | 20114461 | U1 | 6/2001 |
| DE | 10245556 | B3 | 4/2004 |
| DE | 10 2004 047 759 | B3 | 6/2006 |
| EP | 1460769 | A1 | 9/2004 |
| EP | 1463246 | A1 | 9/2004 |
| EP | 1715723 | A2 | 10/2006 |
| JP | 63031700 | A | 2/1988 |
| JP | 06083616 | A | 3/1994 |
| JP | 06214682 | A | 8/1994 |
| JP | 07015390 | A | 1/1995 |
| JP | 08275297 | A | 10/1996 |
| JP | 2004519317 | W | 7/2004 |
| JP | 2004242315 | A | 8/2004 |
| JP | 2004535082 | A | 11/2004 |
| JP | 2006217063 | A | 8/2006 |
| JP | 2007088787 | A | 5/2007 |

* cited by examiner

*Primary Examiner* — Jerome Jackson, Jr.
*Assistant Examiner* — Dale E Page

(57) ABSTRACT

The invention relates to a multi-component hearing aid system, comprising at least one first component that is designed to be disposed on or in the ear of a patient for the purpose of generating and/or amplifying an auditory stimulus and at least one further component which can engage at least partially and/or temporarily in a wireless communication connection via which a data transmission can take place with the first component that is to be worn on or in the ear, wherein circuitry means are included which can place at least one source of interference contained in the hearing aid system at least during the transmission of data into an operating mode in which interference signals are coupled by said at least one source of interference into a receiver involved in the data transmission in a manner that is at least attenuated compared to the normal operating mode.

11 Claims, 3 Drawing Sheets

MULTI-COMPONENT HEARING AID SYSTEM AND A METHOD FOR ITS OPERATION

CROSS REFERENCE TO RELATED APPLICATIONS

The present application claims the benefit of a provisional patent application filed on Jul. 2, 2007, and assigned application No. 60/958,089, which is incorporated by reference herein in its entirety.

FIELD OF THE INVENTION

The invention relates to a multi-component hearing aid system as well as to a method for its operation, in particular for data transmission between components of the hearing aid system.

BACKGROUND OF THE INVENTION

Hearing aids serve primarily for providing hearing-impaired patients with as natural a hearing sensation as possible and in this regard compensate for usually medically induced malfunctions of the acoustic organs. At the same time, like most medical aids, they have to fulfill this functionality without provoking other adverse effects for their wearer. Adverse effects of said kind can result, for example, from an inappropriate weight of the hearing aid or from, say, restrictions on movement associated with the wearing of hearing aids. Added to this in the case of medical aids that have to be positioned in the region of the face or head is that aesthetic considerations also play a special role. This is particularly true since effort is often aimed at ensuring that the infirmity compensated by the hearing aid should remain hidden from the environment of a patient equipped with an aid of said kind.

The aforementioned requirements are leading to a progressive weight reduction and miniaturization of at least the hearing aid components worn in proximity to the ear. However, there are limits to said miniaturization due to the increasing complexity and functionality of modern hearing aids, which is why multi-component systems have become established in which individual functions of the hearing aid have been exported into an auxiliary device or other components that are to be positioned independently of the ear. In order nonetheless to be able to use these exported functions, at least partial communication is necessary between components of the hearing aid system that are disposed at the ear of the patient and other components which can be arranged at a different location. In particular as a consequence of the demands in terms of comfort that are placed on contemporary hearing aids it follows that said communication between the individual components of a hearing aid system generally takes place wirelessly. This applies in the same way to hearing aid systems comprising a plurality of components which are to be disposed on or in the ears and which are included in a communication connection.

DE 10 2004 047 759 B3 describes a hearing aid which is intended to improve the transmission and amplification of a useful signal in particular in difficult environments, i.e. environments affected by interference signals. Toward that end it is proposed to transmit signals between a first hearing aid worn by a first hearing aid wearer and a second hearing aid worn by a second hearing aid wearer. In this arrangement the transmitted signal can include control parameters, sound field characteristic values or an audio signal. Furthermore it is possible for the signals transmitted between the first hearing aid and the second hearing aid to be transmitted via at least one additional hearing aid worn by at least one additional hearing aid wearer. In this case the third hearing aid fulfills the function of a relay station.

Hearing aid systems within the meaning of the invention are to be understood in the following description to include all multi-component hearing aid systems which comprise at least one component requiring to be disposed on or in the ear of a patient, and which comprise a further component which is communicatively connected at least partially and/or temporarily to the component that is to be worn on the ear. Said further component can be disposed independently of the ear of the patient and/or comprise, in the case of binaural systems, a further component requiring to be disposed on or in the patient's other ear. Included in this context are hearing aids which can be adapted to the personal needs of the respective hearing aid wearer with the aid of a suitable programming device during individual sessions at the practice of a hearing aid acoustician and/or which have auxiliary devices via which the patient him-/herself or another person independent of the hearing aid acoustician can individually adjust or set specific parameters on the hearing aid.

Implicit in the wireless connection concept is that with the exception of systems which can be supplied with energy via inductive couplings, each component of a multi-component hearing aid system must have its own energy source. For components that are worn directly on the or in the ear of a patient it follows from the requirements described in the introduction that an energy source of said kind should be as small and as easy to configure as possible, but on the other hand must possess sufficient capacity to ensure the operational reliability of the hearing aid system over a relatively long period of time without necessitating frequent maintenance measures in the meantime. For this reason hearing aid systems are generally designed in such a way that at least the components of the hearing aid system that are worn directly on or in the ear of the patient are characterized by very low energy consumption. This applies to the maintaining of the functionality as a medical aid just as much as to the implementation of the communication between individual hearing aid components. Standards for inductive wireless transmission of data between individual components of multi-component hearing aid systems have become established for said communication.

With the inductive wireless transmission of data from a hearing aid system component that is to be worn close to the ear to a device equipped with a suitable receiving apparatus, for example an auxiliary device in the form of a relay station, a programming device or a remote control, there is the problem that due to the relatively low capacity, voltage and peak-current-carrying capacity of batteries that are typically used, the maximum transmit power of such hearing aid system components that are to be worn close to the ear is also very limited. This results in a correspondingly short transmission range. An additional factor, in particular for inductive systems that are common today, is that in the near field normally used the reduction in field strength as a function of the distance from the transmitter is of particular consequence. Accordingly, with currently known inductive systems, depending on their design, only distances of approx. 30 cm are spanned on the link from a hearing aid system component designed to be worn on the ear to a receiving apparatus. Due to the low level of the useful signal at the receiving apparatus, even very low-power sources of interference can massively influence the transmission quality or impede or prevent the identification of the data that is to be transmitted.

Due to their very design, however, essential components of a hearing aid system, including auxiliary devices designed to receive data, generate electromagnetic emissions which act as sources of interference during the data transmission and during the data transmission are situated between the individual components in immediate proximity to the transmission link, in particular to the active receiver in each case, i.e. in inductive systems close to the active receiving coil in each case. Sources of interference of this kind are, for example, the inductances of clocked voltage regulators or the supply and output lines of practically all clocked electronic circuits. Circuits of said kind are used for controlling displays, for example. Devices with displays constitute strong emitters overall in this context. In the actual hearing aid, i.e. in components that are to be worn close to the ear, the hearing aid earpiece itself can contribute an additional source of interference.

It is known to shield modules acting as sources of interference. However, effective shielding of magnetic interference fields requires the use of components with relatively large space requirements, for example in μ-metal boxes. In particular in the case of hearing aid components that are to be worn in or on the ear, the necessary space for this is usually not available and the weight disadvantage associated therewith not acceptable.

A sufficiently great distance between the receiving coil and modules acting as sources of interference can likewise not be provided in particular in the case of hearing aid components that are to be worn in or on the ear. With auxiliary devices that are not required to be worn in immediate proximity to the ear, the trend is also toward integration of a high degree of functionality in the device while keeping dimensions to a minimum, so that here too the aim 1s to keep the volume of the modules used as well as their maximum distance from one another as small as possible.

On the assumption that the local arrangement of transmitting and receiving coils and all sources of interference in the hearing aid or in the components of the hearing aid system is fixed and known at least during the data transmission, the receiving coil can in principle be placed in a minimum of the interference field to be expected. Orthogonal alignments of mutually influencing coils and/or interference fields are known for example. It is also known to realize local interference field compensation by generating defined opposing fields. This, however, leads to significant restrictions in terms of design freedom and degree of miniaturization of devices configured in such a manner.

SUMMARY OF THE INVENTION

The object of the invention consists in disclosing a means of exchanging data reliably between individual components of a multi-component hearing aid system without having to accept the shortcomings of the prior art.

The object is achieved by the claims.

The invention is based essentially on placing identified sources of interference at least during the transmission of data into an operating mode in which interference signals are coupled into one or all of the receivers involved in the data transmission in a manner that is at least attenuated compared to the normal operating mode of said sources of interference. This change in the operating mode of sources of interference can include their temporary deactivation, but can also consist in a change in the operating mode of the identified source of interference in which only the radiation properties of the source of interference change, but the functions of the component acting as a source of interference are preserved during the data transmission. A change of said kind can include reducing the interference power by reducing the power injected into the source of interference or a change in the interference spectrum, which in the case of clocked components may be associated with a change of timing.

Typical methods for wireless, in particular inductive data transmission between the components of the hearing aid system can advantageously be adapted in harmony with the invention in such a way that the time at which at least one transmitter is operating is precisely known. At this time at least one source of interference is then placed into a different operating mode in order to facilitate the reception of the sent signals or the data transmission.

A minimum configuration for use of the invention therefore comprises a multi-component hearing aid system having at least one first component to be disposed on or in the ear of a patient for the purpose of generating and/or amplifying an auditory stimulus and at least one further component which is engaged at least partially and/or temporarily in a wireless communication connection via which a data transmission can take place with the component that is to be worn on or in the ear, wherein circuitry means are included which can place at least one source of interference contained in the hearing aid system at least during the transmission of data into an operating mode in which interference signals coupled by this at least one source of interference into a receiver involved in the data transmission are at least attenuated compared to the normal operating mode.

With the deactivation of the sources of interference or, as the case may be, a reduction in the interference power or a manipulation of the interference spectrum, the reception situation in a receiving component of the hearing aid system, i.e. an auxiliary device for example, can be considerably improved temporarily at precisely defined times without noticeably compromising the performance of the individual components in normal operation if the change in the operating mode of the sources of interference only takes place in short time windows in which deviations from the normal operation of the hearing aid system that occur are not perceptible.

In certain cases changes in the operating mode of sources of interference are also conceivable which involve deviations from the normal operation of the hearing aid system that lie above the perceptibility threshold. Since the data transmission from a hearing aid system component that is to be worn close to the ear to an auxiliary device is for example an operating situation which occurs very infrequently in the normal application of a hearing aid system, for example during a programming session when the hearing aid data is being read out or in the case of an interrogation of the status of the hearing aid components by a remote control, the possibly perceptible performance restriction associated therewith is tolerable. Thus, the momentary deactivation of the hearing aid earpiece or a display unit on the auxiliary device will scarcely have disruptive effects.

Means can advantageously also be included which compensate at least temporarily for the loss of function of a deactivated source of interference. Thus, in the case of switching regulators, for example, the outage time can be bridged by adequately dimensioned backup capacitors.

The change in the operating mode of the identified sources of interference, where appropriate their deactivation, advantageously takes place during the transmission of data in all components of the hearing aid system which, during the existence of the wireless communication connection, are located in the vicinity of receivers involved. The deactivation or, as the case may be, change in the operating mode of the sources of interference both in the receiving component and in the sending component has the advantage that the influence of sources of interference in the sending component which can also cause reception problems or interference in the receiver of the receiving component in the local area when there is a relatively small distance between transmitter and receiver is also reduced or excluded. In this way an adverse effect on the transmission of data in the case of very short distances between the individual components of the hearing aid system due to design factors is precluded.

BRIEF DESCRIPTION OF THE DRAWINGS

The invention is explained in more detail below with reference to exemplary embodiments and the accompanying drawings, in which.

DETAILED DESCRIPTION OF THE INVENTION

Figure 1:
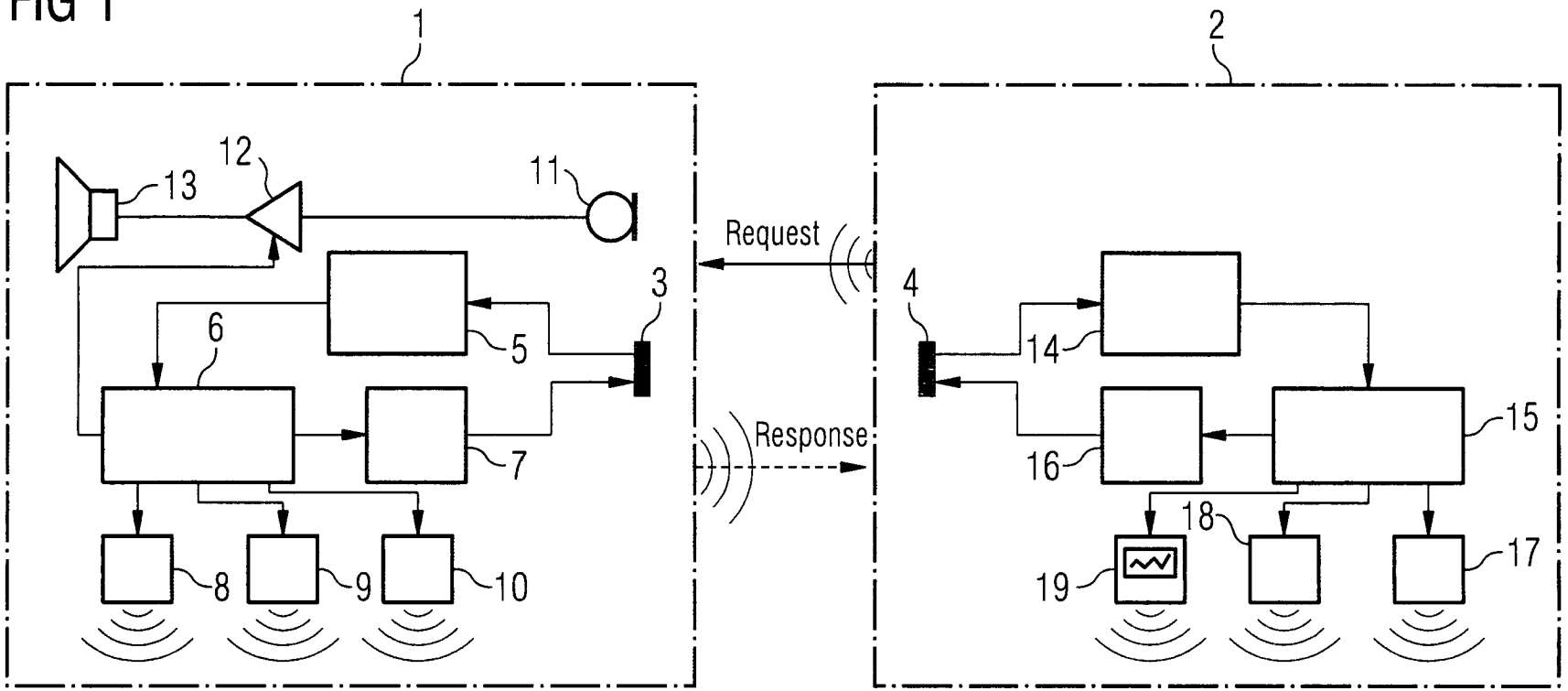
FIG. 1 is a schematic circuit diagram of an inventive hearing aid system consisting of two components.

FIG. 1 shows a schematic circuit diagram of a hearing aid system according to the invention, consisting of two components. The two components of the hearing aid system are a hearing aid component 1 designed to be worn on the ear of a patient for the purpose of amplifying sound pressure and an auxiliary device 2 by means of which individual acoustic parameters of the hearing aid component to be worn on the ear can be set, as can be carried out by the patient him-/herself with the aid of a remote control for example. In an alternative that is not shown, the auxiliary device can also be a programming device of a hearing aid acoustician.

In order to carry out the settings, a communication is required for the purpose of data transmission between the hearing aid component 1 and the auxiliary device 2. During the data transmission the auxiliary device 2 is brought close to the ear-worn hearing aid component 1 so that it is situated within range of the data transmission means disposed on the hearing aid component 1. In the present case the data transmission takes place wirelessly over an inductive data transmission link. For this purpose at least one coil 3, 4 which can be used as transmitter and receiver is contained in each case in the ear-worn hearing aid component 1 and in the auxiliary device 2. The ear-worn hearing aid component 1 also comprises a receiver module 5, a control unit 6 and a transmitter module 7. Signals received at the receiving coil 3 are first supplied to the receiver module 5, conditioned there accordingly and supplied in the form of usable output signals to the control unit 6. Various forms of signal processing are performed in the control unit 6 in order to enable the received signals to be used in a way that is meaningful for the functionality of the hearing aid system. The control unit 6 also possesses means for changing the respective operating mode of individual identified sources of interference 8, 9, 10. In particular clocked electronic components, such as switching regulators or other components tending to harmonic-rich emissions, but also components which are directly part of the acoustic transmission link of the hearing aid can act as sources of interference of the aforesaid kind. In the present case the acoustic transmission link comprises a microphone 11, an amplifier 12 and a loudspeaker 13 in the form of an earpiece to be placed in the ear. Said loudspeaker 13 can likewise act as a source of interference. The sources of interference can be identified on the basis of the component specification or by corresponding measurements already during the design phase of the hearing aid system. The auxiliary device 2 likewise includes a receiver module 14, a control unit 15, a transmitter module 16 and other sources of interference 17, 18, including also a display 19.

The hearing aid system shown is configured in such a way that the time at which the coil 3 in the hearing aid component 1 operates as a transmitter is known precisely in the auxiliary device 2. For this purpose a communication protocol is realized in such a way that the hearing aid component 1 always transmits data only in response to a request by the auxiliary device 2 and never independently initiates a transmission. The auxiliary device 2, which possesses a powerful power supply and accordingly has a relatively high transmit power, therefore sends a request to the hearing aid component 1 in the form of an invitation to transmit desired data. In this case the relatively high transmit power of the transmitter module 16 of the auxiliary device 2 guarantees that this request can be reliably identified by the hearing aid component 1, even when the sources of interference 8, 9, 10, 13 in the hearing aid component 1 and the sources of interference 17, 18, 19 in the auxiliary device 2 are in operation unchanged. Simultaneously with the request, the control units 6, 15 initiate a change in the operating mode of the sources of interference 8, 9, 10, 13, 17, 18, 19, in this case a deactivation. During the transmission of the data from the hearing aid component 1 to the auxiliary device 2 all sources of interference 8, 9, 10, 13, 17, 18, 19 that are not directly required for transmitting or receiving the data now remain deactivated for the duration of the transmission, i.e. for 50 ms for example, both in the sending hearing aid component 1 and in the receiving auxiliary device 2. The hearing aid component 1 responds solely to the request by the auxiliary device 2 by sending the requested data. In this way it is ensured by means of an event-driven change in the operating mode of the sources of interference 8, 9, 10, 13, 17, 18, 19 that interference effects are reduced during the transmission of data between the components 1, 2 of the hearing aid system.

Alternatively, instead of being deactivated, sources of interference suited thereto can also be placed momentarily into an operating state which is possibly energetically less favorable, i.e. temporarily increases the energy consumption of the battery-powered hearing aid component 1, but in which the interference emissions lie in a frequency range that is noncritical for the receiver. In addition the quality of the communication connection can be improved in that the sources of interference 8, 9, 10, 13, 17, 18, 19 are also placed into a low-interference operating state when the auxiliary device 2 transmits data to the hearing aid component 1.

During a data transmission as just described it is already sufficient for the purposes of implementing the invention to place individual sources of interference, for example such sources of interference which transmit particularly critical interferences in the form of interference signals that are particularly difficult to differentiate from useful signals, into an operating mode in which interference signals are coupled by said at least one source of interference into a receiver involved in the data transmission in a manner that is at least attenuated compared to the normal operating mode. Advantageously, however, all identified sources of interference in range of the receivers involved in the data transmission are placed into an operating mode of said kind.

Figure 2:
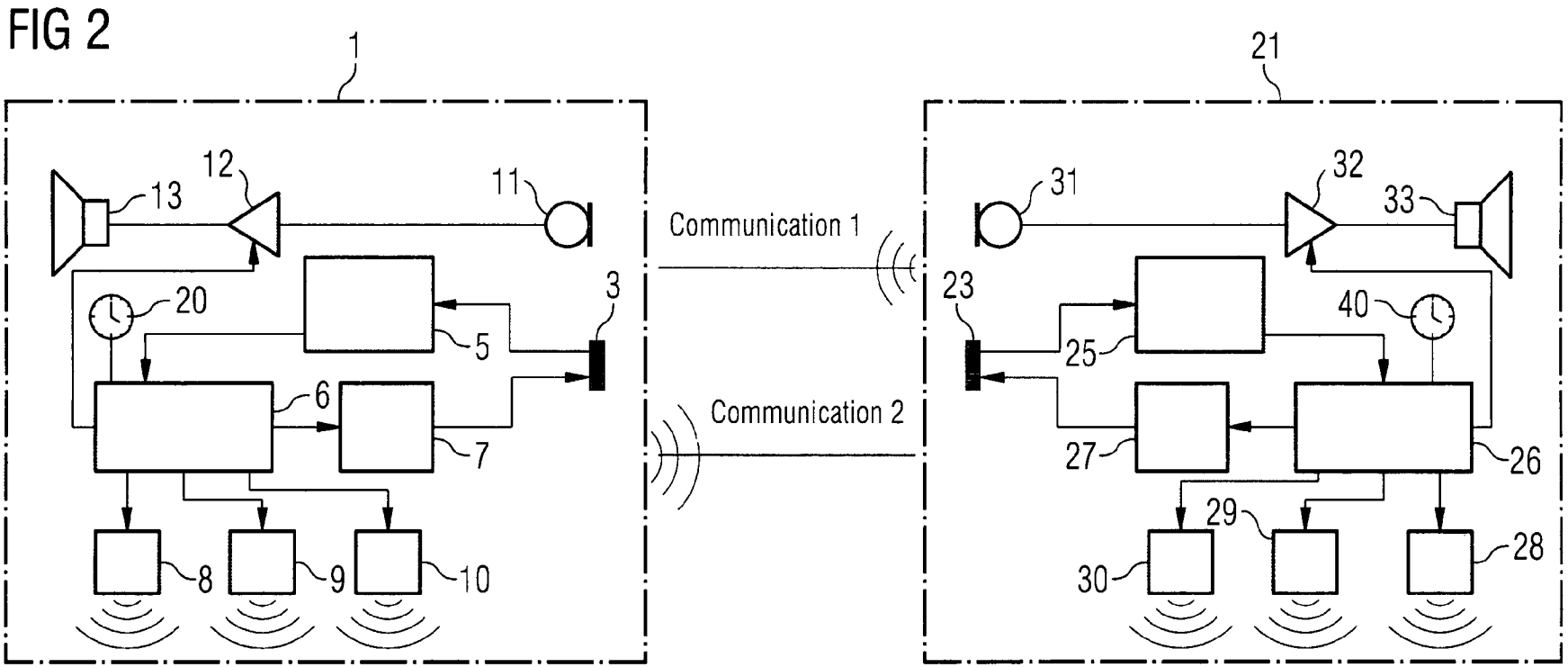
FIG. 2 is a schematic circuit diagram of a binaural hearing aid system with data transmission according to the invention.

FIG. 2 shows a schematic circuit diagram of a binaural hearing aid system with data transmission according to the invention. A binaural hearing aid system of this kind has two separate hearing aid components 1, 21 for sound pressure amplification, each of which is disposed on an ear of the hearing aid wearer. A communication for the purpose of data exchange is likewise required between said hearing aid components. This results on the one hand from the necessity of a parameter alignment and various status queries that have to be executed at regular intervals, and on the other hand from physical factors which, for the purpose of implementing certain hearing aid functions, require the interaction of at least two microphones disposed at a distance from each other. In this case the communication between such hearing aid components must usually take place at much shorter time intervals than is the case for example for the setting of parameters by external auxiliary devices. When two independent hearing aid components for sound pressure amplification are present, each of these is equipped with a separate energy supply which will usually be configured symmetrically, i.e. each of the hearing aid components has only a very small battery with limited capacity. In this case it would be unfavorable to assign one of the hearing aid components communication tasks which are associated with a significantly higher energy consumption compared to the other hearing aid component, since that would lead to earlier exhaustion of the battery in the respective hearing aid component and that would run counter in part to the object of the invention.

In the present binaural hearing aid system the communication means in the individual hearing aid components are for this reason configured symmetrically, i.e. each of the two hearing aid components 1, 21 has the same means for maintaining or establishing a communication connection for the purpose of data exchange, and the communication protocol required for their operation is likewise realized symmetrically. Each of the hearing aid components 1, 21 has a coil 3, 23 which can be used as transmitter and receiver. Each of the hearing aid components 1, 21 also includes a receiver module 5, 25, a control unit 6, 26 and a transmitter module 7, 27. The individual modules can be linked analogously to the preceding exemplary embodiment. The control units 6, 26 in turn possess means for changing the respective operating mode of individual identified sources of interference 8, 28, 9, 29, 10, 30. Each hearing aid component 1, 21 also includes an acoustic transmission link comprising a microphone 11, 31, an amplifier 12, 32 and a loudspeaker 13, 33 as a sound pressure generating output unit.

It is possible also in hearing aid systems of this kind to realize the communication protocol in such a way that the time at which a coil 3, 23 operates as a transmitter in one of the hearing aid components 1, 21 is precisely known. In contrast to the preceding exemplary embodiment, however, this synchronization is not accomplished in an event-driven manner by means of a request-response system, but is time-controlled. Toward that end the control units 6, 26 additionally possess means for generating time information, e.g. a timer circuit 20, 40 which transmits a time signal to the control unit 6, 26 at least at regular intervals. Given corresponding synchronicity of these time signals transmitted to the control units 6, 26, using this as a basis, a communication connection for the transmission of different data can be established exactly simultaneously by the two hearing aid components 1, 21, wherein during the time that said communication connection exists, the operating mode of known sources of interference 8, 28, 9, 29, 10, 30 and 13, 33 is in turn changed in an inventive manner, as a result of which said sources of interference 8, 28, 9, 29, 10, 30, 13, 33 find themselves in an operating mode in which interference signals are coupled in at least an attenuated manner into the receiver involved in the data transmission in each case. The communication between the two hearing aid components 1, 21 can thus take place largely free of interference effects, i.e. a high level of transmission reliability of the data to be transmitted exists even at low transmit power.

Figure 3:
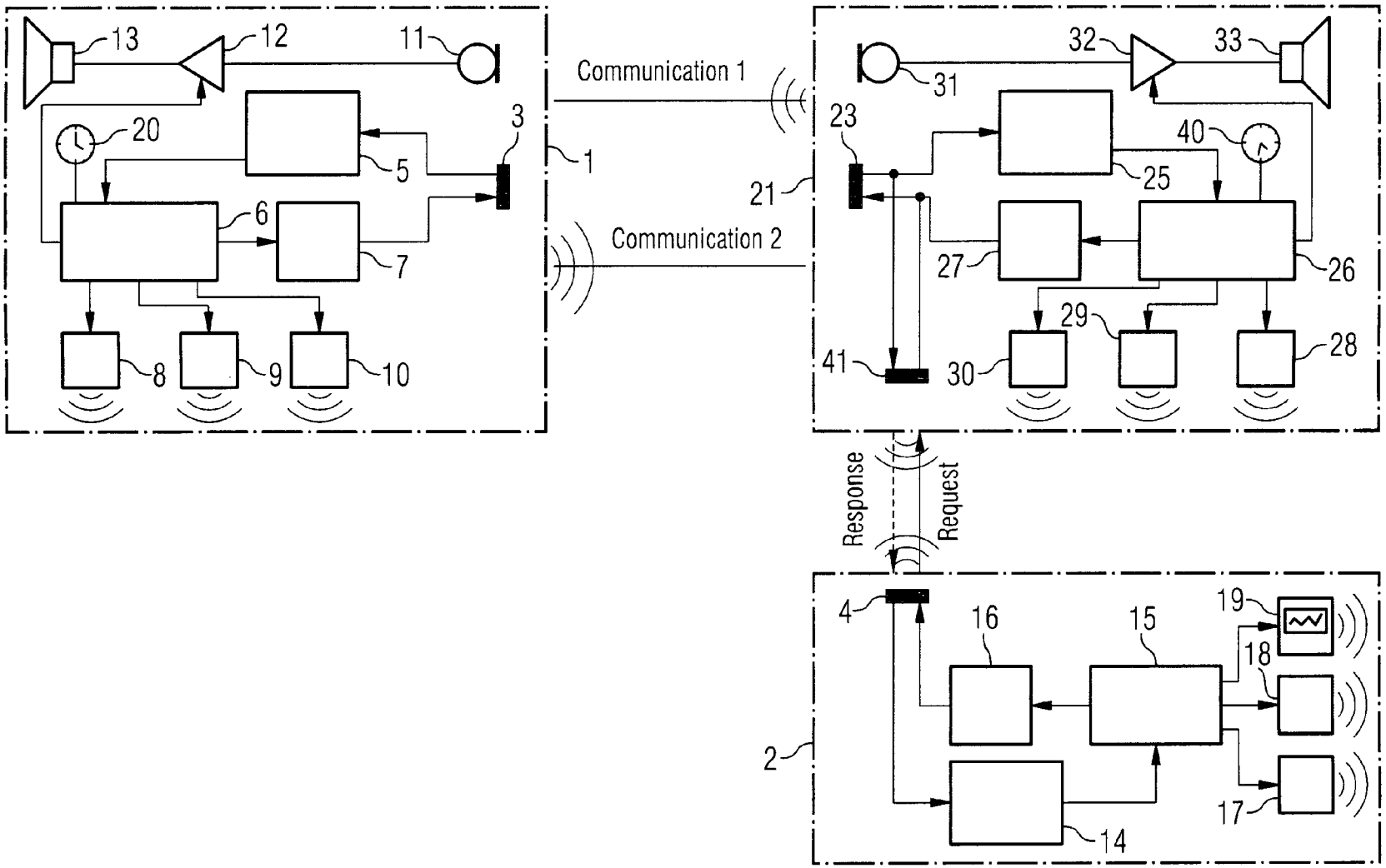
FIG. 3 is a schematic circuit diagram of a binaural hearing aid system according to the invention having an auxiliary device suitable for data communication.

FIG. 3 shows a schematic circuit diagram of a binaural hearing aid system according to the invention having an auxiliary device suitable for data communication. The advantages of the two already cited exemplary embodiments are united in the exemplary embodiment shown in FIG. 3. Firstly, said hearing aid system comprises two separate hearing aid components 1, 21, each of which is disposed on an ear of the hearing aid wearer, and secondly, the hearing aid system shown comprises an auxiliary device 2 which can establish a communication connection with one of the hearing aid components 21. The communication connection between the two hearing aid components 1, 21 is established cyclically in a time-dependent manner. The operating mode of identified sources of interference 8, 9, 10, 13, 28, 29, 30, 33 is correspondingly changed in a time-dependent manner. The communication between the auxiliary device 2 and the hearing aid component 21 takes place in an event-driven manner by means of a request-response system, wherein at least the request always originates in the auxiliary device 2 and is transmitted at a substantially higher transmit power. The change in the operating mode of the identified sources of interference 17, 18, 19, 28, 29, 30, 33 is correspondingly effected in an event-dependent manner by means of the request.

The initiation of a communication connection by means of a request which is transmitted at high transmit power is always useful when the requesting component of the hearing aid system, i.e. in the present case the auxiliary device 2, possesses sufficient energy reserves and said communication connection does not have to be established regularly and/or very frequently.

The time-dependent establishment of a communication connection with simultaneous changing of the operating mode of relevant sources of interference is always useful when said communication connection has to be established very frequently and/or regularly and the transmission of a request signal consuming a relatively large amount of energy would place too heavy a load on the energy budget of the communicating hearing aid components 1, 21.

In the exemplary embodiment shown, the hearing aid component 21 has an additional transmitting and receiving coil 41 via which the communication with the auxiliary device 2 can proceed. In an alternative variant (not shown) it is, however, also possible to implement the communication with the auxiliary device 2 and the other hearing aid component 1 worn close to the ear via one and the same coil 23. In a further embodiment that is not shown it is also possible to equip both hearing aid components 1, 21 worn close to the ear with an external auxiliary device 2 via means for establishing a communication connection, thereby resulting in the possibility of direct access by such auxiliary devices, for example remote controls or programming devices, to the respective hearing aid component 1, 21. In this way the hearing aid components 1, 21 can be adapted directly to needs of the hearing aid wearer without the requirement for parameters to be passed via the communication connection existing between the hearing aid components 1, 21.

The invention claimed is:

1. A hearing aid system, comprising:

a first component;

a further component that communicates with the first component in a wireless communication connection for a data transmission; and a control unit that:

operates a plurality of sources of interference of the hearing aid system in an operating mode during the data transmission, and attenuates signals of the sources of interference in the operating mode during the data transmission compared to a normal operating mode of the hearing aid system, wherein the control unit is configured to reduce a power injected into the source of interference in the operating mode, wherein the further component is configured to send a request to the first component to invite a transmission of requested data, wherein the first component is configured to transmit the requested data only in response to the request by the further component and never initiate the data transmission, and wherein sources of interference that are not requested by the further component are deactivated during the data transmission.

2. The hearing aid system as claimed in claim 1, wherein the control unit operates the source of interference into the operating mode during the data transmission based on an event-driven change.

3. The hearing aid system as claimed in claim 1, wherein the first component is disposed on or in an ear of a patient and generates or amplifies an auditory stimulus.

4. The hearing aid system as claimed in claim 3, wherein the hearing aid system is a binaural hearing aid system comprising two of the first component and wirelessly exchanges data between the two of the first component.

5. The hearing aid system as claimed in claim 1, wherein the source of interference is selected from the group consisting of: a switching regulator, a display, a clocked circuit, and a hearing aid earpiece.

6. The hearing aid system as claimed in claim 5, wherein the control unit varies a timing of the clocked component in the operating mode.

7. The hearing aid system as claimed in claim 1, wherein the further component comprises a remote control or a programming device of the hearing aid system.

8. The hearing aid system as claimed in claim 1, wherein the wireless communication connections is an inductive communication connection.

9. The hearing aid system as claimed in claim 1, wherein the signal of the source of interference is coupled into a receiver of the first or the further component during the data transmission.

10. The hearing aid system as claimed in claim 1, wherein the control unit is arranged in the first or the further component.

11. The hearing aid system as claimed in claim 1, wherein the further component is configured to possess a higher transmit power than the first component so that data transmitted from the further component to the first component is identified by the first component even when the operating mode of the sources of interference is unchanged.

* * * * *